US005922259A

United States Patent [19]

Okuyama et al.

[11] Patent Number: 5,922,259

[45] Date of Patent: Jul. 13, 1999

[54] CORD OF TWISTED POLYBENZAZOLE FIBERS

[75] Inventors: Yukinari Okuyama; Hiroshi Hirahata; Kazuyuki Yabuki, all of Otsu, Japan

[73] Assignee: Toyo Boseki Kabushiki Kaisha, Osaka-fu, Japan

[21] Appl. No.: 08/682,953

[22] Filed: Jul. 18, 1996

[30] Foreign Application Priority Data

Aug. 9, 1995 [JP] Japan ..... 7-203463

[51] Int. Cl.[6] ..... B29D 28/00

[52] U.S. Cl. ..... 264/103; 264/178 F; 264/203; 264/205; 264/210.2; 264/210.7; 264/210.8; 264/211.12; 264/211.14; 264/211.16; 521/61; 521/64; 528/183; 528/190; 528/193; 528/337; 528/487; 528/499

[58] Field of Search ..... 521/61, 64; 528/487, 528/499, 193, 337, 183, 190; 264/103, 205, 203, 178 F, 210.2, 210.7, 210.8, 211.12, 211.14, 211.16

[56] References Cited

U.S. PATENT DOCUMENTS

| | | | |
|---|---|---|---|
| 5,286,833 | 2/1994 | Bubeck et al. | 528/183 |
| 5,296,185 | 3/1994 | Chau et al. | 264/205 |
| 5,385,702 | 1/1995 | Mills et al. | 264/103 |
| 5,525,638 | 6/1996 | Sen et al. | 521/61 |
| 5,534,205 | 7/1996 | Faley et al. | 264/103 |

*Primary Examiner*—Terressa Mosley
*Attorney, Agent, or Firm*—Morrison & Foerster LLP

[57] ABSTRACT

There is provided a cord of twisted polybenzazole fibers, which has a tenacity of 35 g/d or higher and an elastic modulus of 800 g/d or higher. The cord has not only remarkably improved fatigue resistance but also excellent mechanical characteristics at a high level that has not been achieved so far. Therefore, it can attain the weight reduction of composite materials, particularly in the field of reinforced rubber materials, and can also make a great contribution to the energy saving.

6 Claims, 4 Drawing Sheets

CORD OF TWISTED POLYBENZAZOLE FIBERS

FIELD OF THE INVENTION

The present invention relates to a cord of twisted polybenzazole fibers, which has remarkably improved fatigue resistance as compared with the conventional cords.

BACKGROUND OF THE INVENTION

Usually organic fibers used in reinforced rubber or other materials have a twisted structure for the purpose of improving their fatigue resistance. In recent years, some attempts have been made to attain the weight reduction of these reinforced rubber materials at the request for the energy saving. Up to the present, however, satisfactory weight reduction is not attained in spite of the use of super fibers.

SUMMARY OF THE INVENTION

Under these circumstances, the present inventors have intensively studied to develop a cord with remarkably improved fatigue resistance, from which high tenacity and high elastic modulus of original fibers can be fully utilized for those of the cord as a reinforcing material. As a result, they have found that the use of twisted polybenzazole fibers makes it possible to attain this purpose, thereby completing the present invention.

Thus the present invention provides a cord of twisted polybenzazole fibers, which has a tenacity of 35 g/d or higher and an elastic modulus of 800 g/d or higher. These characteristics can be retained, even if the cord is subjected to dip treatment. In other words, the present invention further provides a dip cord of twisted polybenzazole fibers, which is obtained by dip treatment and kept having a tenacity of 35 g/d or higher and an elastic modulus of 800 g/d or higher.

The cord of the present invention can attain the weight reduction of composite materials, particularly in the field of reinforced rubber materials, and can also make a great contribution to the energy saving.

DETAILED DESCRIPTION OF THE INVENTION

Figure 1:
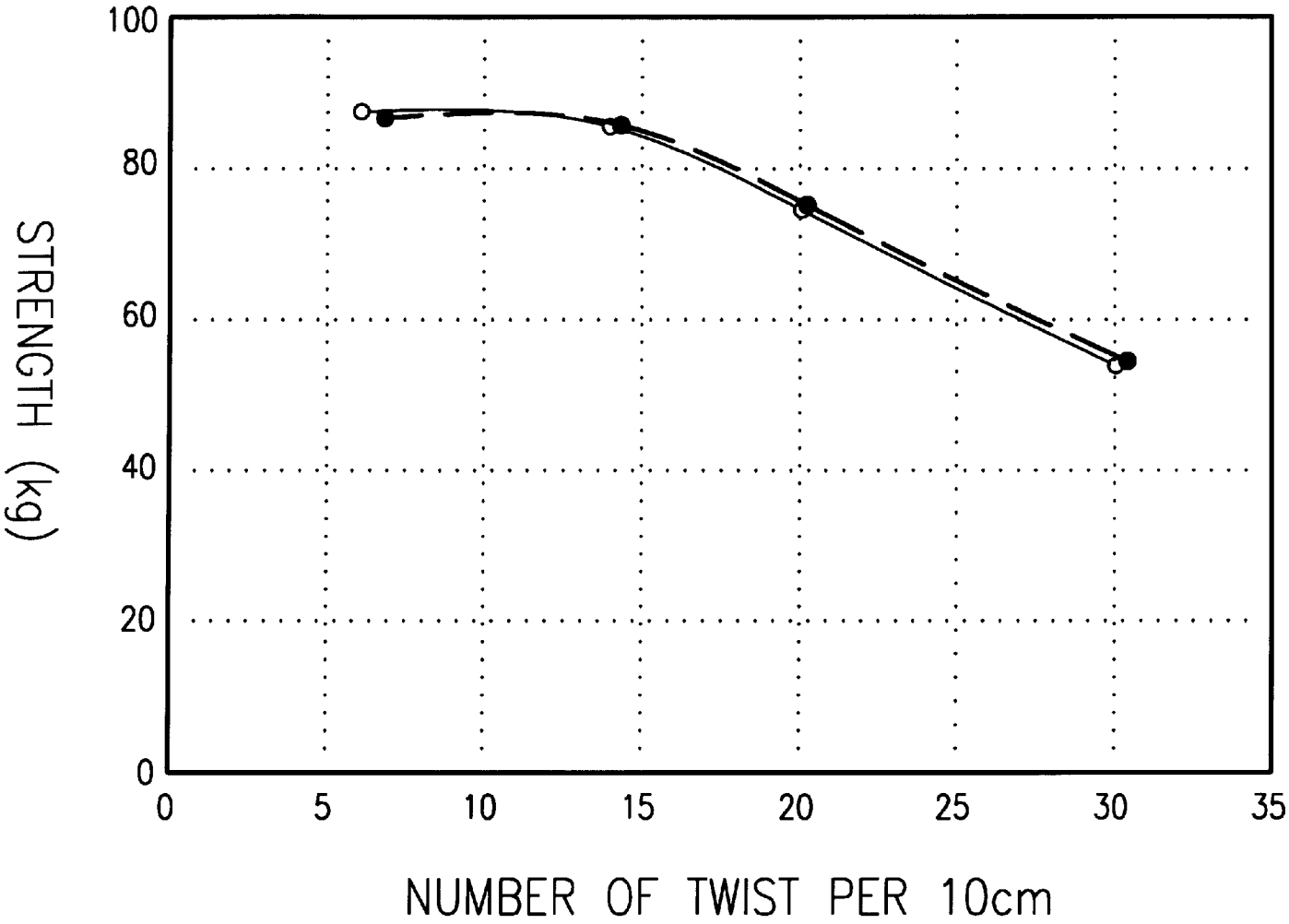
FIG. 1 is a graph showing the relationships between the strength and the number of twist for various greige cords and dip cords prepared in Examples 1–3 and Comparative Example 1. The open circles and solid circles represent experimental data for the greige cords and dip cords, respectively, and the solid line and broken line only represent their tendencies.

The cord of the present invention comprises twisted polybenzazole fibers.

The term "polybenzazole fibers" as used herein refers to various fibers made of a polybenzazole (PBZ) polymer selected from the group consisting of polybenzoxazole (PBO) homopolymers, polybenzothiazole (PBT) homopolymers, and random, sequential or block copolymers of polybenzoxazole and polybenzothiazole. The polybenzoxazole, polybenzothiazole, and random, sequential or block copolymers thereof are disclosed in, for example, Wolfe et al., "Liquid Crystalline Polymer Compositions, Process and Products", U.S. Pat. No. 4,703,103 (Oct. 27, 1987), "Liquid Crystalline Polymer Compositions, Process and Products", U.S. Pat. No. 4,533,692 (Aug. 6, 1985), "Liquid Crystalline Poly-(2,6-Benzothiazole) Compositions, Process and Products", U.S. Pat. No. 4,533,724 (Aug. 6, 1985), "Liquid Crystalline Polymer Compositions, Process and Products", U.S. Pat. No. 4,533,693 (Aug. 6, 1985); Evers, "Thermooxidatively Stable Articulated p-Benzobisoxazole and p-Benzobisthiazole Polymers", U.S. Pat. No. 4,359,567 (Nov. 16, 1982); and Tsai et al., "Method for Making Heterocyclic Block Copolymer", U.S. Pat. No 4,578,432 (Mar. 25, 1986).

The structural unit contained in the PBZ polymer is preferably selected from lyotropic liquid crystal polymers. Examples of the monomer unit for these polymers are depicted by the following structural formulas (a) to (h). It is preferred that the PBZ polymer is substantially composed of at least one monomer unit with a structure selected from these structural formulas (a) to (h), more preferably (a) to (c):

(a)

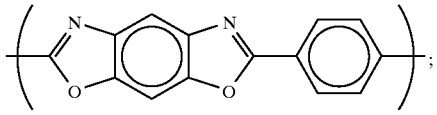

(b)

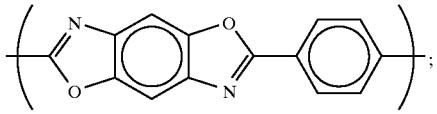

(c)

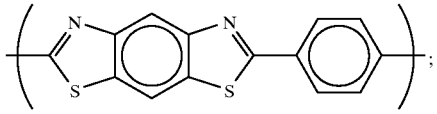

(d)

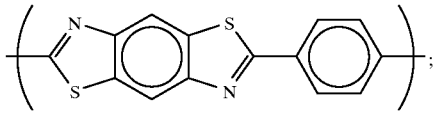

-continued (e)

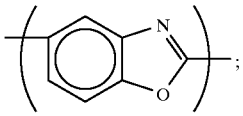

(f)

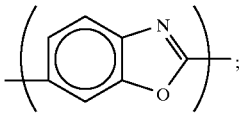

(g)

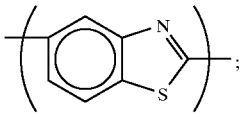

and (h)

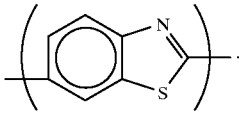

The solvent for preparing a dope of the PBZ polymer preferably includes cresol and non-oxidative acids in which the PBZ polymer can be dissolved. Preferred examples of the acid solvent are polyphosphoric acid, methanesulfonic acid, and sulfuric acid of high concentration, or mixtures thereof. More preferred solvents are polyphosphoric acid and methanesulfonic acid. The most preferred solvent is polyphosphoric acid.

The polymer concentration in the solvent is preferably at least about 7% by weight, more preferably at least 10% by weight, and most preferably at least 14% by weight. The maximum concentration is limited by actual handling conditions such as polymer solubility and dope viscosity. Because of these limiting factors, the polymer concentration cannot exceed 20% by weight in usual cases.

The preferred polymer or copolymer, or the dope thereof, can be prepared by any of the known methods, such as disclosed in Wolfe et al., U.S. Pat. No. 4,533,693 (Aug. 6, 1985); Sybert et al, U.S. Pat. No. 4,772,678 (Sep. 20, 1988); and Harris, U.S. Pat. No. 4,847,350 (Jul. 11, 1989). According to the disclosure of Gregory, U.S. Pat. No. 5,089,591 (Feb. 18, 1992), it is possible to raise the degree of polymerization for the PBZ polymer under relatively high temperature and high shearing conditions in a dehydrating acid solvent.

From the dope thus polymerized, polybenzazole fibers with high tenacity and high elastic modulus can be produced by any of the known methods. The dry-and-wet spinning method as disclosed in, for example, U.S. Pat. No. 5,294,390 (May 15, 1994) is preferred.

The polybenzazole fibers used in the present invention are provided with a single twist or a two-folded twist using a ring twister or the like from the viewpoint of improving the fatigue resistance. In the case of polybenzazole fibers with a single twist, the twist constant is 900 or less, preferably 350 or less, which is essential to high tenacity and high elastic modulus, as well as remarkably improved fatigue resistance, in the cord of the present invention. In particular, to achieve the fatigue resistance improvement, it is preferred that the cord of the present invention comprises polybenzazole fibers with a single twist and having a twist constant of 700 or less, more preferably 350 or less. The cord comprising polybenzazole fibers with a two-folded or multi-folded twist is not preferred because the degree of strength utilization is decreased. The twist constant K is defined as follows:

$$K=Tw(\mathrm{Den}/\rho)^{1/2}$$

where Tw is the number of twist per 10 cm, Den is the total denier, and p is the fiber density in g/cm$^3$.

The cord of twisted polybenzazole fibers may be subjected to dip treatment, so called, for improving the adhesion to rubber when used in reinforced rubber materials. The dip treatment is usually conducted in a single- or multi-stage process with a treatment liquid including, but not limited to, aqueous dispersions of epoxy resins, aqueous dispersions of blocked isocyanates, and mixtures of resorcinol-formaldehyde resins and rubber latices (RFL), which can be used alone or in combination. In particular, these examples of the treatment liquid are important because the uniformity of their migration in the cord makes it possible to raise the fatigue resistance and the degree of strength and elastic modulus utilization. For this reason, the dip treatment is preferably conducted under high tension, and the composition of dip agents penetrating into the fibers is preferably selected from the soft compositions, so called, with low elastic modulus.

The cord thus obtained has a degree of strength utilization (i.e., ratio of cord strength to original fiber strength) of 80% or higher, and also has a high degree of elastic modulus utilization. Moreover, it was surprisingly found in the fatigue test that the cord of the present invention has better fatigue resistance with a decrease in the twist constant. Thus the cord of the present invention has a novel feature which is not in accordance with the previous common knowledge that fatigue resistance becomes better with an increase in the number of twist for the organic fibers.

The present invention will be further illustrated by the following examples which are not to be construed to limit the scope thereof.

EXAPLES 1–3 AND COMPARATIVE XAMPLE 1

Various cords were prepared by twisting two paralleled polybenzobisoxazole fibers of 1000 deniers. These greige cords were then subjected to two-stage dip treatment to produce dip cords. In the dip treatment, the first stage was conducted at 250° C. with an aqueous dispersion of an epoxy resin, and the second stage, at 235° C. with an RFL liquid. The characteristics of the greige cords and dip cords thus obtained are shown in Table 1.

Figure 2:
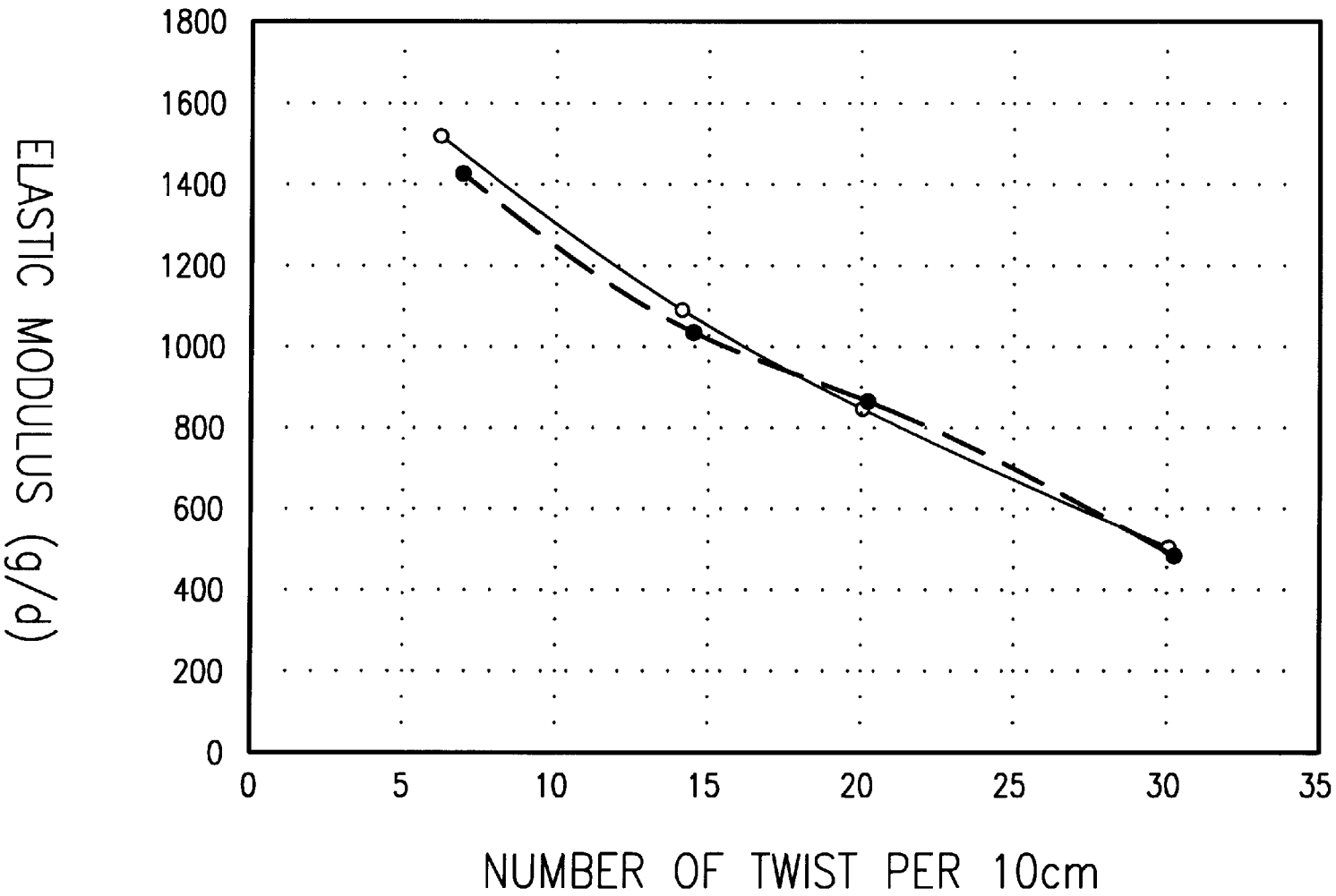
FIG. 2 is a graph showing the relationships between the elastic modulus and the number of twist for various greige cords and dip cords prepared in Examples 1–3 and Comparative Example 1. The open circles and solid circles represent experimental data for the greige cords and dip cords, respectively, and the solid line and broken line only represent their tendencies.
Figure 3:
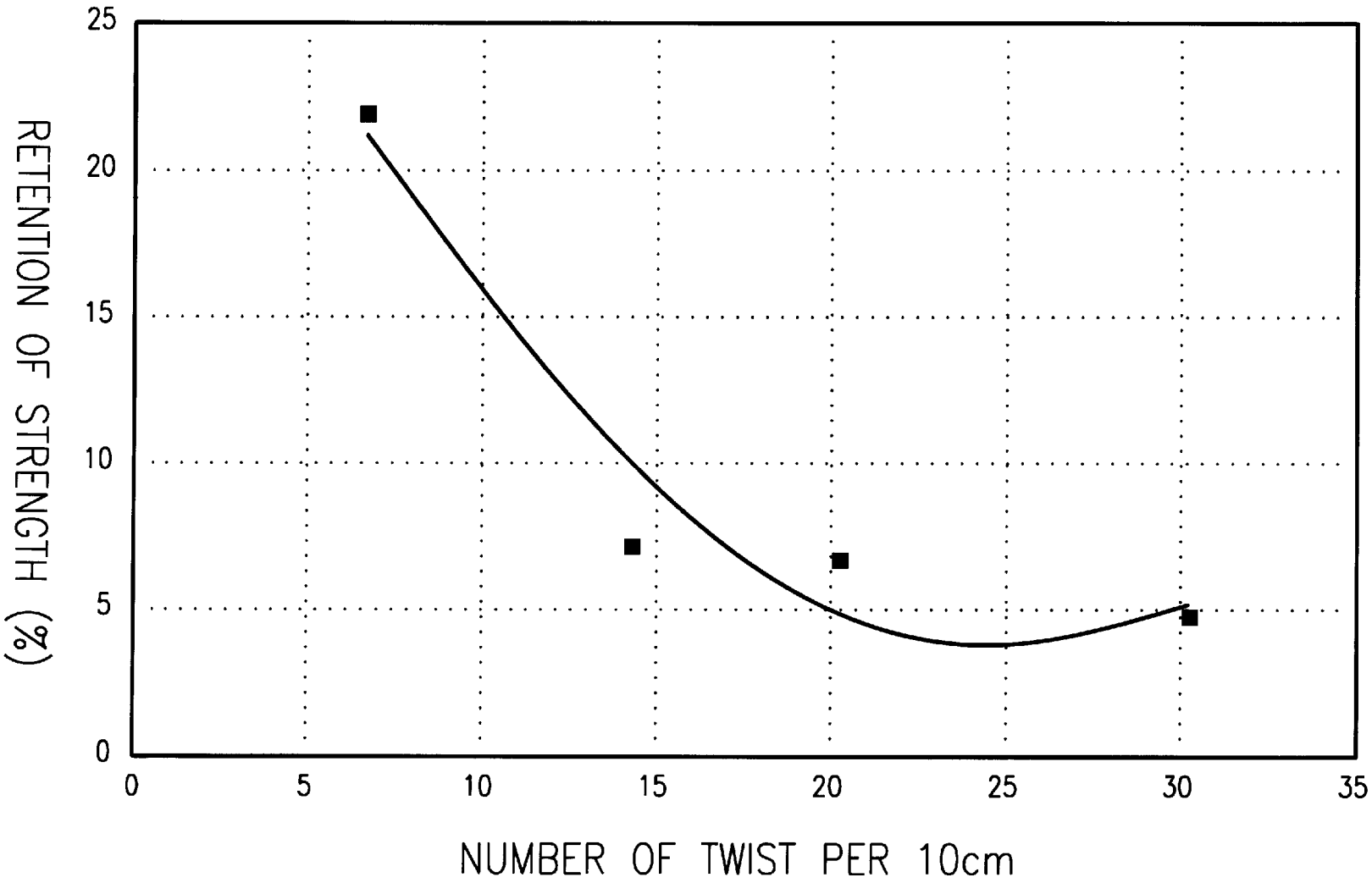
FIG. 3 is a graph showing the relationship between the retention of strength in the disk fatigue test and the number of twist for various dip cords prepared in Examples 1–3 and Comparative Example 1. The solid squares represents experimental data for the dip cords, and the solid line only represents their tendency.
Figure 4:
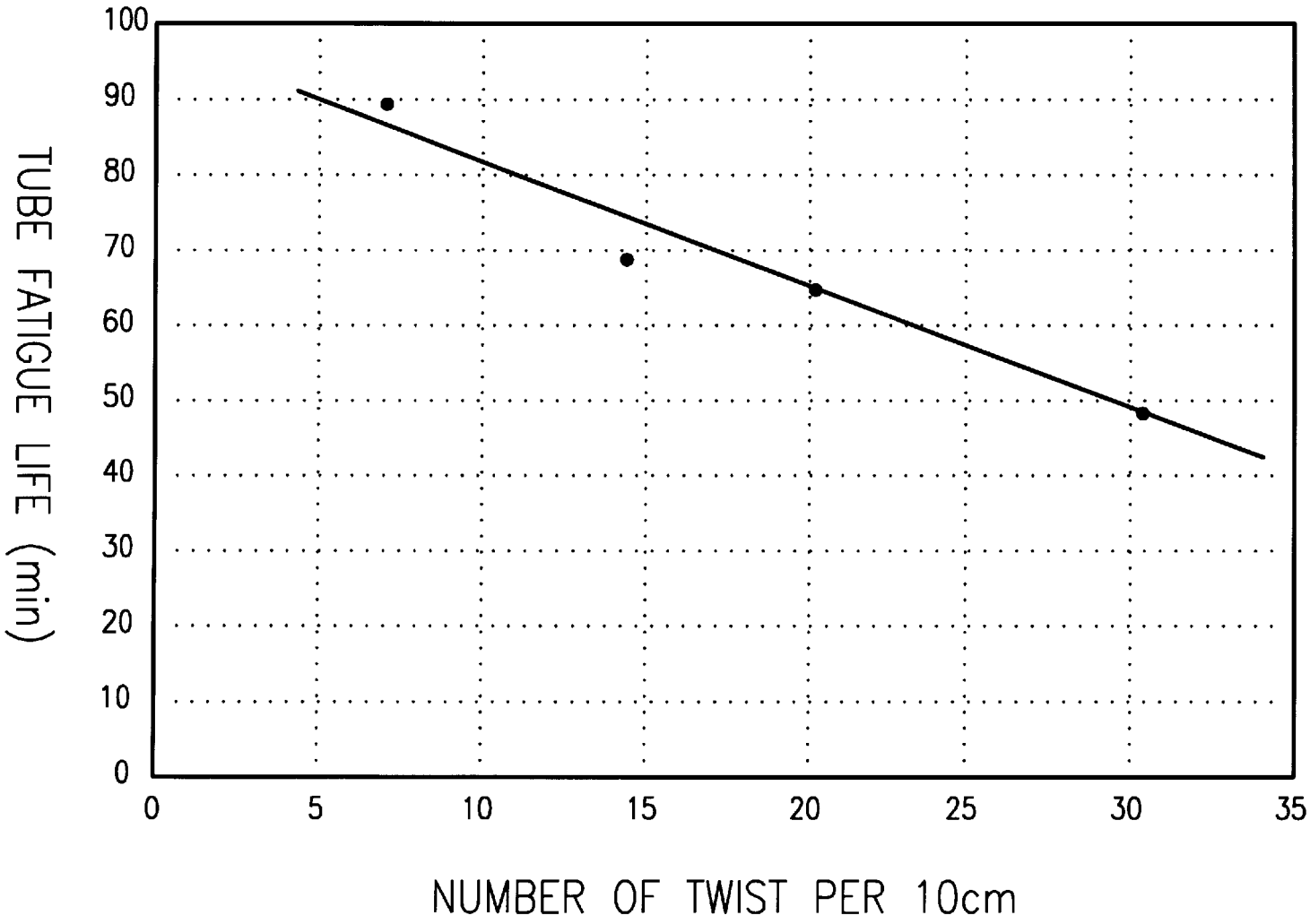
FIG. 4 is a graph showing the relationship between the tube fatigue life and the number of twist for various dip cords prepared in Examples 1–3 and Comparative Example 1. The solid circles represents experimental data of the dip cords, and the solid line only represents their tendency.

As can be seen from Table 1, the greige cord and dip cord of Example 1, where the twist constant of polybenzobisoxazole fibers was 350 or less, had a quite high degree of strength utilization and a quite high degree of elastic modulus utilization, as well as high fatigue resistance. The dependencies of strength, elastic modulus, retention of strength, and tube fatigue life on the number of twist are shown in FIGS. 1–4, respectively. In particular, the fatigue characteristics of the single twist cords became more excellent with a decrease in the twist constant, and they became remarkable at a twist constant of 350 or less.

Moreover, variations in the cord strength and elastic modulus before and after the dip treatment were quite small, and a strength loss by the dip treatment, which had become a problem in the conventional case, was not observed.

TABLE 1

| | Example 1 | Example 2 | Example 3 | Comp. Example 1 |
|---|---|---|---|---|
| Characteristics of greige cords | | | | |
| Constitution* | 1000//2 | 1000//2 | 1000//2 | 1000//2 |
| Number of twist per 10 cm | 6.2 | 14.1 | 20.1 | 30.1 |
| Twist constant | 223 | 504 | 719 | 1077 |
| Cord gauge (mm) | 0.29 | 0.41 | 0.45 | 0.52 |
| Fineness (denier) | 1994 | 2014 | 2048 | 2114 |
| Strength (kg) | 87.1 | 84.9 | 73.8 | 52.7 |
| Degree of strength utilization (%) | 97 | 94 | 82 | 59 |
| Tenacity (g/d) | 43.7 | 42.2 | 36.1 | 24.9 |
| Elongation at break (%) | 2.8 | 3.3 | 3.5 | 3.8 |
| Elastic modulus (g/d) | 1521 | 1080 | 819 | 475 |
| Degree of elastic modulus utilization (%) | 76 | 54 | 41 | 24 |
| Characteristics of dip cords | | | | |
| Constitution* | 1000//2 | 1000//2 | 1000//2 | 1000//2 |
| Number of twist per 10 cm | 6.96 | 14.4 | 20.24 | 30.24 |
| Twist constant | 249 | 516 | 725 | 1083 |
| Cord gauge (mm) | 0.335 | 0.428 | 0.453 | 0.508 |
| Fineness (denier) | 2117 | 2113 | 2132 | 2198 |
| Water content (%) | 0.43 | 0.4 | 0.45 | 0.36 |
| Strength (kg) | 87.2 | 84.9 | 73.8 | 52.7 |
| Degree of strength utilization (%) | 97 | 94 | 82 | 59 |
| Tenacity (g/d) | 41.2 | 40.2 | 34.6 | 24.0 |
| Elongation at break (%) | 2.4 | 3.0 | 3.3 | 3.6 |

TABLE 1-continued

| | Example 1 | Example 2 | Example 3 | Comp. Example 1 |
|---|---|---|---|---|
| Elastic modulus (g/d) | 1425 | 1027.7 | 834.49 | 455.27 |
| Degree of elastic modulus utilization (%) | 71 | 51 | 42 | 23 |
| Disk fatigue (kg) | 19.0 | 6.2 | 5.1 | 2.6 |
| Retention of strength (%) | 21.8 | 7.4 | 6.9 | 4.9 |
| Tube fatigue life (min) | 90.3 | 69.2 | 64.8 | 48.0 |

*: "1000//2", a cord obtained by twisting two paralleled fibers of 1000 deniers.
"1000/2", a cord obtained by finish twisting a two-folded yarn made of first-twisted fibers of 1000 deniers.

EXAPLES 4–5 AND OMPARATIVE EXAMPLE 2

A single twist cord and two-folded twist cords were prepared by twisting polybenzobisoxazole fibers. These greige cords were subjected to two-stage dip treatment as described above to produce dip cords. The characteristics of the greige cords and dip cords thus obtained are shown in Table 2. A remarkable difference was observed at the similar low number of twist between the single twist cord and the two-folded twist cord, and the single twist cord of Example 4 was by far the best. The characteristics of the two-folded twist cords had an ordinary tendency that is generally observed in the super fibers, whereas the characteristics of the single twist cord were not expected from the previous common knowledge.

TABLE 2

| | Example 4 | Example 5 | Comp. Example 2 | Comp. Example 3 | Comp. Example 4 |
|---|---|---|---|---|---|
| Characteristics of greige cords | | | | | |
| Constitution*, twist | 1000//2 single | 1000/2 two-folded | 1000/2 two-folded | 1000/2 two folded | 1000/2 two folded |
| Number of twist per 10 cm, finish twist × first finish | 9.7 | 10.0 × 10.0 | 26.4 × 26.6 | 35.4 × 35.1 | 47.7 × 49.2 |
| Twist constant | 347 | 358 | 945 | 1268 | 1708 |
| Cord gauge (mm) | 0.36 | 0.38 | 0.46 | 0.50 | 0.51 |
| Fineness (denier) | 2005 | 2017 | 2094 | 2108 | 2200 |
| Strength (kg) | 89.0 | 83.2 | 65.7 | 57.3 | 46.1 |
| Degree of strength utilization (%) | 99 | 92 | 73 | 64 | 51 |
| Tenacity (g/d) | 44.4 | 41.2 | 31.4 | 27.2 | 21.0 |
| Elongation at break (%) | 3.0 | 3.0 | 3.4 | 4.1 | 5.2 |
| Elastic modulus (g/d) | 1350 | 1185 | 857 | 597 | 283 |
| Degree of elastic modulus utilization (%) | 68 | 59 | 43 | 30 | 14 |
| Characteristics of dip cords | | | | | |
| Constitution*, twist | 1000//2 single | 1000/2 two folded | 1000//2 two folded | 1000//2 two folded | 1000//2 two folded |
| Number of twist per 10 cm, finish twist × first twist | 9.6 | 9.9 × 10.1 | 26.4 × 26.4 | 35.5 × 35.1 | 47.9 × 49.8 |
| Twist constant | 344 | 354 | 945 | 1271 | 1715 |
| Cord gauge (mm) | 0.38 | 0.4 | 0.51 | 0.51 | 0.53 |
| Fineness (denier) | 2113 | 2133 | 2151 | 2205 | 2277 |
| Water content (%) | 0.43 | 0.44 | 0.42 | 0.41 | 0.50 |
| Strength (kg) | 88.5 | 79.6 | 63.5 | 56.2 | 42.6 |
| Degree of strength utilization (%) | 98 | 88 | 71 | 62 | 47 |
| Tenacity (g/d) | 41.9 | 37.3 | 29.5 | 25.5 | 18.7 |
| Elongation at break (%) | 3.0 | 2.9 | 3.3 | 3.6 | 4.3 |
| Elastic modulus (g/d) | 1316 | 1139 | 870 | 644 | 307 |
| Degree of elastic modulus utilization (%) | 86 | 57 | 44 | 32 | 15 |

TABLE 2-continued

| | Example 4 | Example 5 | Comp. Example 2 | Comp. Example 3 | Comp. Example 4 |
|---|---|---|---|---|---|
| Disk fatigue (kg) | 13.1 | 0.0 | 0.0 | 8.4 | 13.7 |
| Retention of strength (%) | 14.8 | 0.0 | 0.0 | 14.9 | 32.2 |
| Tube fatigue life (min) | 83.0 | 22.8 | 25.0 | 32.8 | 88.1 |

*: "1000//2", a cord obtained by twisting two paralleled fibers of 1000 deniers.
"1000/2", a cord obtained by finish twisting a two-folded yarn made of first-twisted fibers of 1000 deniers.

As described above, the cord of the present invention, in which the excellent physical characteristics of polybenzazole fibers are fully utilized, has not only remarkably improved fatigue resistance but also excellent mechanical characteristics at a high level that has not been achieved so far. Therefore, it can attain the weight reduction of composite materials, particularly in the field of reinforced rubber materials, and can also make a great contribution to the energy saving.

What is claimed is:

1. A cord of twisted polybenzazole fibers, having:

a tenacity of 35 g/d or higher;

an elastic modulus of 800 g/d or higher; and a twist constant of 900 or less.

2. A cord according to claim 1, wherein the twisted polybenzazole fibers have a twist constant of 700 or less and is provided with a single twist.

3. A cord according to claim 1, wherein the degree of strength utilization from the polybenzazole fibers is 80% or more.

4. A cord according to claim 1, which is a dip cord obtained by dip treatment and kept having a tenacity of 35 g/d or higher and an elastic modulus of 800 g/d or higher.

5. A cord according to claim 1, wherein the polybenzazole fibers are made of a polymer material selected from the group consisting of polybenzoxazole homopolymers, polybenzothiazole homopolymers, and copolymers of polybenzoxazole and polybenzothiazole.

6. A cord according to claim 5, wherein the polymer material comprises a monomer unit selected from the group selected from the group consisting of:

(a)

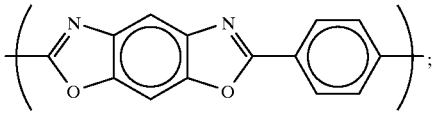

(b)

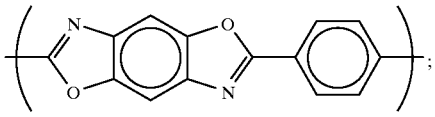

-continued (c)

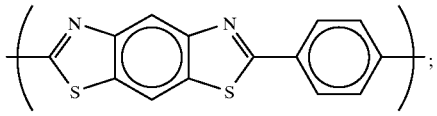

(d)

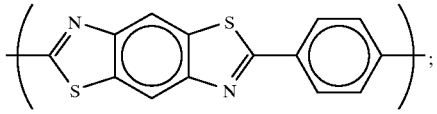

(e)

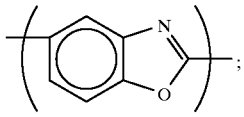

(f)

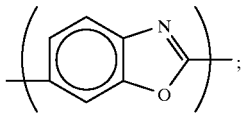

(g)

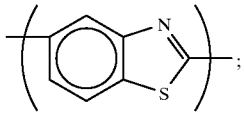

and (h)

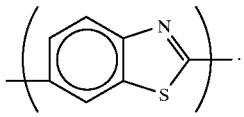

* * * * *